US007553203B2

(12) United States Patent
Anbo et al.

(10) Patent No.: US 7,553,203 B2
(45) Date of Patent: Jun. 30, 2009

(54) CONNECTING TERMINAL

(75) Inventors: Tsugio Anbo, Tokyo (JP); Yukifumi Machida, Tokyo (JP); Claude Casses, Clevilliers (FR)

(73) Assignees: FCI, Versailles (FR); Mitsubishi Cable Industries, Ltd., Chiyoda-Ku, Tokyo (JP)

( * ) Notice: Subject to any disclaimer, the term of this patent is extended or adjusted under 35 U.S.C. 154(b) by 0 days.

(21) Appl. No.: 10/561,013

(22) PCT Filed: Jun. 17, 2004

(86) PCT No.: PCT/JP2004/008536

§ 371 (c)(1),
(2), (4) Date: Feb. 21, 2007

(87) PCT Pub. No.: WO2004/114468

PCT Pub. Date: Dec. 29, 2004

(65) Prior Publication Data

US 2007/0270050 A1 Nov. 22, 2007

(30) Foreign Application Priority Data

Jun. 18, 2003 (JP) ..... 2003-173928

(51) Int. Cl.
*H01R 11/22* (2006.01)
*H01R 13/11* (2006.01)

(52) U.S. Cl. ..... 439/852

(58) Field of Classification Search ..... 439/852, 439/851, 843, 845
See application file for complete search history.

(56) References Cited

U.S. PATENT DOCUMENTS

| | | | | |
|---|---|---|---|---|
| 5,951,339 | A * | 9/1999 | Chaillot et al. | 439/852 |
| 6,290,553 | B1 * | 9/2001 | Sato et al. | 439/843 |
| 6,352,453 | B2 * | 3/2002 | Saitoh | 439/843 |
| 6,679,738 | B2 | 1/2004 | Nimura | 439/852 |
| 2002/0077000 | A1 | 6/2002 | Nimura | 439/852 |

FOREIGN PATENT DOCUMENTS

| | | | |
|---|---|---|---|
| EP | 1146597 | A1 | 10/2002 |
| JP | 62736 | A | 1/1962 |
| JP | 3-93175 | A | 4/1991 |
| JP | 6-325813 | A | 11/1994 |
| JP | 09232021 | A | 9/1997 |
| JP | 63-7436 | | 1/1998 |
| JP | 2001-506048 | A | 5/2001 |
| WO | WO-95/11531 | | 4/1995 |

* cited by examiner

*Primary Examiner*—Javaid Nasri
(74) *Attorney, Agent, or Firm*—Harrington & Smith, PC

(57) ABSTRACT

A connecting terminal has a rectangular tube-like connecting portion including a bottom plate, and a first side plate. A movable contact strip is secured to the bottom plate at a base portion. The movable contact strip is bent into a shape of a mountain. An apex of the mountain constitutes a contact portion. Prior to the formation of the connecting portion, the movable contact strip is folded over the bottom plate. An elongated strip portion of the bottom plate is cut and bent inwardly to form a reinforcing strip. A rear end of the movable contact strip is connected to the bottom plate. A free front end of the reinforcing strip is urged against a lower surface of the contact portion. At a front end of the connecting portion, a guide strip is formed by folding back a front end portion of the bottom plate.

18 Claims, 4 Drawing Sheets

CONNECTING TERMINAL

TECHNICAL FIELD

The present invention relates to a female type connecting terminal to be connected to a male type connecting terminal, said female type and male type connecting terminal constituting an electrical connector.

TECHNICAL BACKGROUND

It has been practiced to arrange a movable contact strip having an elasticity within a connecting portion of a female type connecting terminal and an inserted male type connecting terminal is clamped resiliently by the movable contact strip. Recently it has been required to provide electrical connectors having a small size and larger number of poles, and therefore connecting terminals arranged within the connectors should be small. For the female type connecting terminal, a contact point of a movable contact strip to be connected to a corresponding male type connecting terminal should be provided at a forward position as far as possible and an insertion force of the male type connecting terminal should be small.

In order to meet the above mentioned requirements there have been proposed the following known connecting terminals.

(1) As shown in FIG. 6, within a connecting portion 1, a movable contact strip 3 and a reinforcing strip 4 are bent upward from a bottom plate 2 and tips of these strips are overlapped with each other at a contact point 5.

(2) As illustrated in FIG. 7, a movable contact strip 3 whose root portion is connected to a top plate 6 is bent such that a free end 7 is face forward within a connecting portion 1.

(3) As depicted in FIG. 8, a root portion of the movable contact strip 3 bent into U-shape is connected to a top plate 6 and a free end 7 of the movable contact strip 3 facing forward is bent toward a bottom plate 2 such that a tip of the free end 7 is engaged with a guide strip 8 provided at a front end of the bottom plate 2.

DISCLOSURE OF THE INVENTION

Problems to be Solved by the Invention

In the known connecting terminal (1), the front end of the movable contact strip 3 is fixed and a rear end of the movable contact strip is free. Therefore, a rather large force is required for inserting the male type connecting terminal into the female type connecting terminal.

In the known connecting terminal (2), the movable contact strip 3 might be deformed in a flat manner due to a repelling force upon the insertion of the corresponding male type connecting terminal, but it is difficult to provide an elongated reinforcing tab extending from the top plate inwardly.

Furthermore in the known connecting terminal (3), the contact point 5 may be provided near a front end and the terminal inserting force may be reduce, but the movable contact strip 3 extending from the top plate and is bent to cross the connecting portion 1 from up to down. Therefore, during a manufacturing process, an abnormal shape of the connecting terminal could not be checked by projecting a light flux along a longitudinal direction of the connecting portion, because the light flux is interrupted by the movable contact strip.

It is an object of the present invention to provide a connecting terminal which can solve the above mentioned problems of the known connecting terminals and a contact point can be provided near a front end and a force for inserting a male type connecting terminal into the female type connecting terminal can be reduced.

Means for Solving the Problems

In order to attain the above mentioned object, according to the invention, a connecting terminal formed from a single metal plate comprises a rectangular tube-like connecting portion including a bottom plate, a first side plate connected to the bottom plate, a top plate connected to the first side plate, and a second side plate connected to the top plate; a movable contact strip formed by folding a strip-like member which extends in parallel with a side portion of said bottom plate and is coupled with said bottom plate at a rear portion and has a free end, over said bottom plate within the connecting portion, said strip-like member being further bent into a shape of mountain such that an apex of the mountain constitutes a contact point; a reinforcing strip having a rear end connected to said bottom plate and a free end, said reinforcing strip being formed by cutting a portion of the bottom plate and bending the thus cut portion inwardly such that the free end of the reinforcing strip supports the movable contact strip; and a guide strip for guiding a corresponding male type connecting terminal of the electrical connector, said guide strip being formed by folding back a strip-like portion provided at the front end of the bottom plate such that said guide strip covers a front end of the movable contact strip.

Merits of the Invention

In the connecting terminal according to the present invention, the movable contact strip is formed by folding the strip-like member over the bottom plate at the rear portion such that the free end situates at a front side, and the movable contact strip is supported by the reinforcing strip from the underneath, said reinforcing strip being formed by bending the cut portion of the bottom plate upwardly. Therefore, the contact point with the corresponding male type connecting terminal can be positioned near the front end, a force for inserting the male type connecting terminal into the female type connecting terminal can be reduced, and the male type connecting terminal can be clamped with a stable force.

EXPLANATION OF REFERENCE NUMERALS

Figure 1:
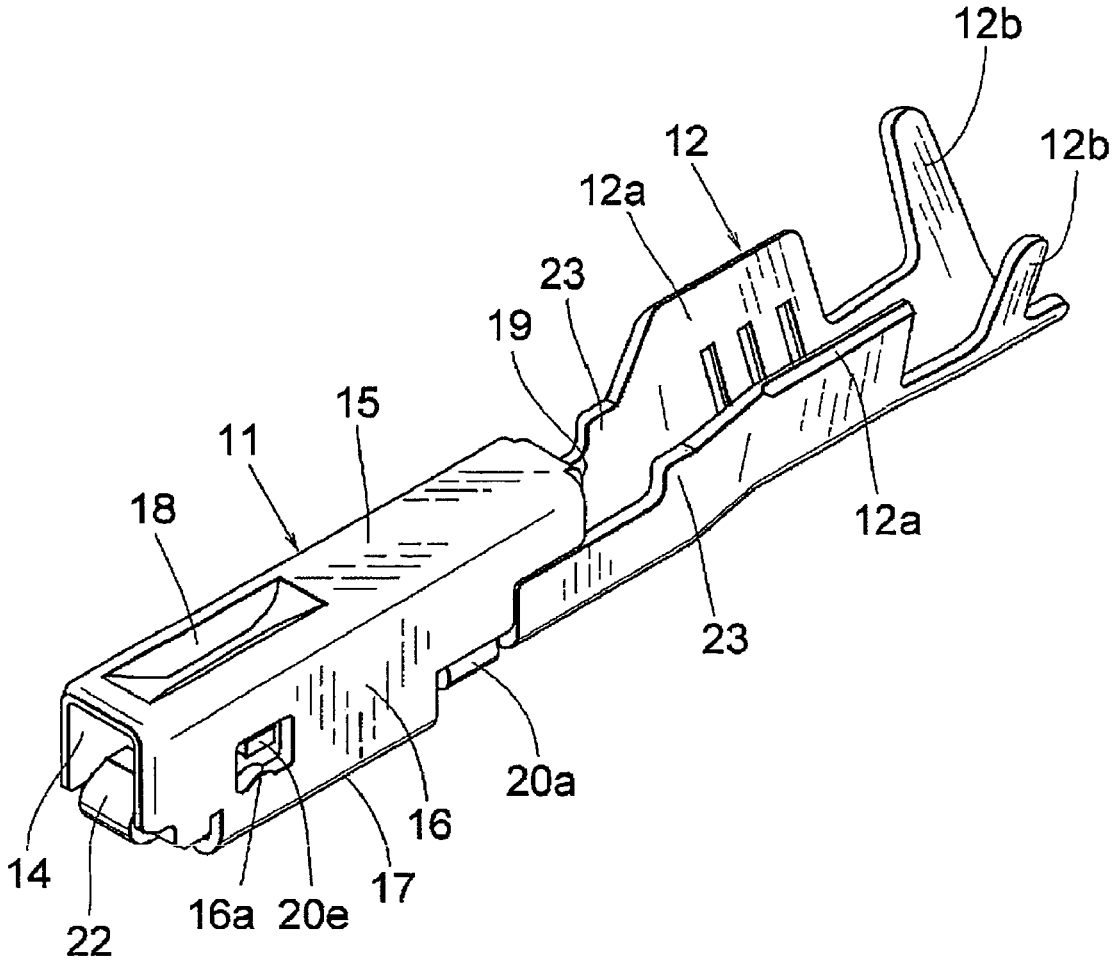
FIG. 1 is a perspective view showing an embodiment of the connecting terminal according to the invention.

11 connecting portion
12 wire clamping portion

13 bottom plate
14, 16 side plate
15 top plate
20 movable contact strip
20*a* base portion
20*b* rear end
20*c* free end
20*d* contact point
20*f* rib portion
21 reinforcing strip
22 guide strip

BEST MODE OF THE INVENTION

Figure 2:
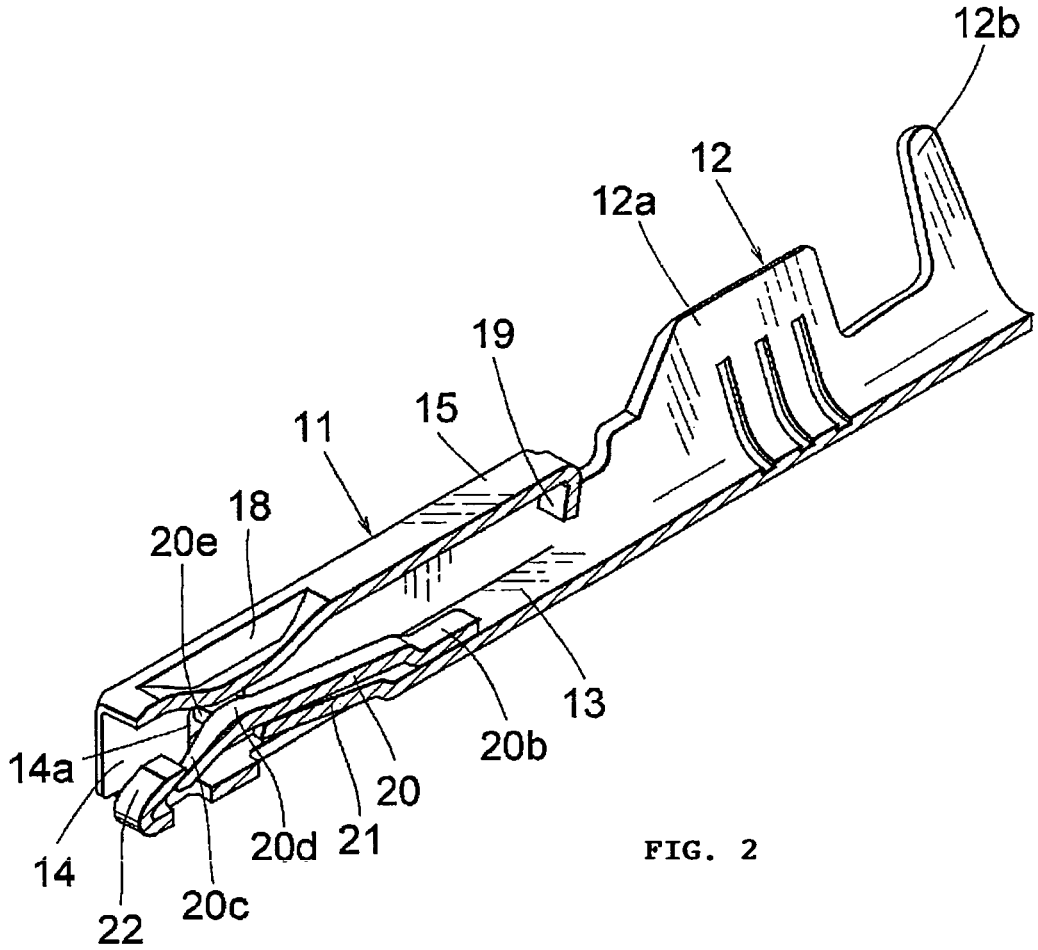
FIG. 2 is a perspective view illustrating the connecting terminal with a portion being cut out.
Figure 3:
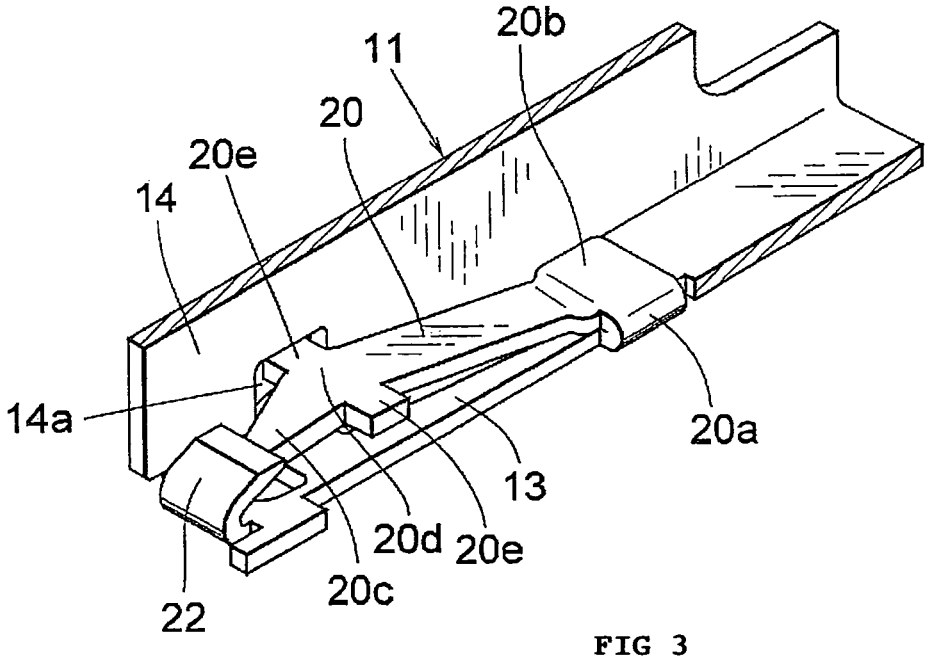
FIG. 3 is an enlarged perspective view depicting a portion of the connecting portion a art of which is cut out.
Figure 4:
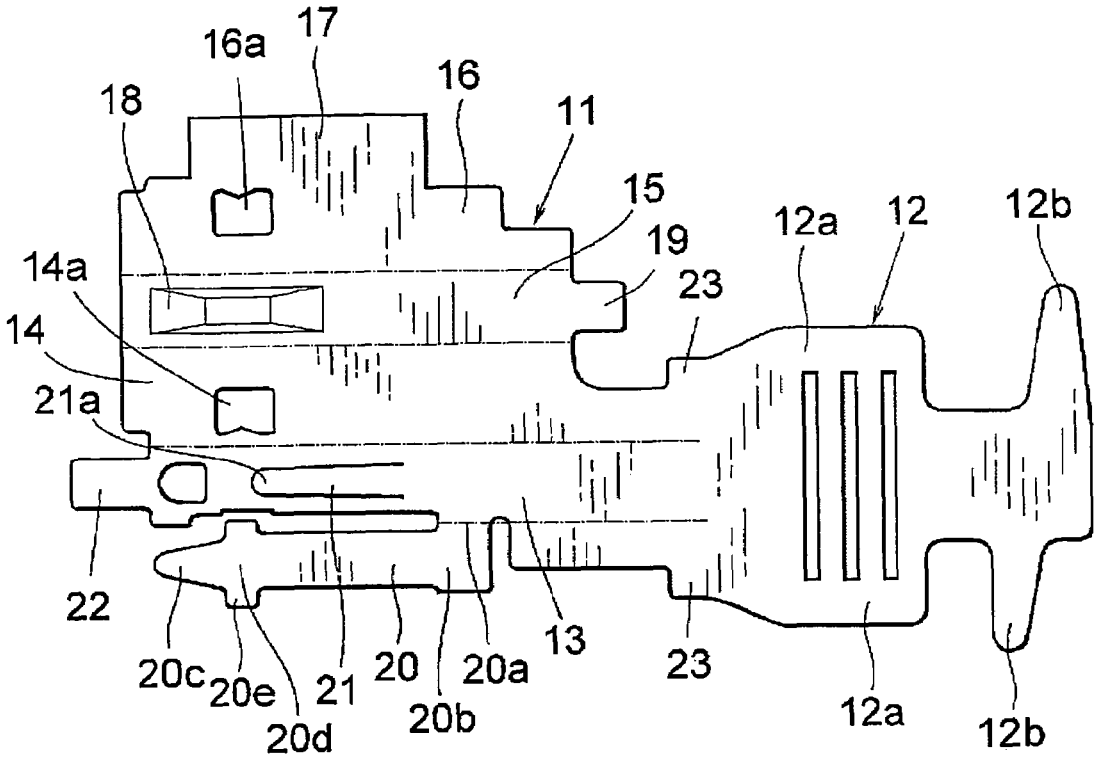
FIG. 4 is a an exploded plan view before assembling.

FIG. 1 is a perspective view showing an embodiment of the connecting terminal according to the invention, FIG. 2 is a perspective view illustrating the connecting terminal with a portion thereof being cut out, FIG. 3 is an enlarged perspective view depicting a connecting portion with a portion thereof being cut out, and FIG. 4 is an exploded plan view before folding and bending. The connecting terminal is formed by punching a single metal plate into a given shape, and then folding and bending various portions. Generally speaking, the connecting terminal consists of a rectangular tube-like connecting portion 11 provided at a front side and a wire clamping portion 12 provided at a rear side. As usual, the wire clamping portion 12 includes a core conductor clamping portion 12*a* and a sheath clamping portion 12*b*, these clamping portions being formed into a U-shape.

As shown in the exploded plan view of FIG. 4, the connecting portion 11 comprises a bottom plate 13, a first side plate 14 connected to one side of the bottom plate, a top plate 14, a second side plate 16 and a stabilizer portion 17, which are successively coupled with each other in this order. The bottom plate 13, first sided plate 14, top plate 15 and second side plate 16 are folded to constitute a rectangular tube. In the top plate 15 there is formed a recess 18 which extends in a longitudinal direction and is bend inwardly. At a rear end of the top plate 15 there is further formed a locking portion 19, which is bent inwardly to be engaged with a locking lance provided on a housing. The stabilizer portion 17 formed at a side of the second side plate 16 is bent to have a semicircular cross section in such a manner that the stabilizer portion 17 protrudes downward from the bottom plate 13 at a side of the second side plate 16.

On the other side of the bottom plate 13 there is formed a movable contact strip 20 to extend in parallel with the bottom plate 13. The movable contact strip 20 is coupled with the rear portion of the bottom plate 13 at a base portion 20*a* within the connecting portion 11. Prior to the formation of the connecting portion 11, the movable contact strip 20 is folded at the base portion 20*a* and is bent in such a manner a portion of the movable contact strip between a rear end 20*b* and a free front end 20*c* is bent upward into a shape of mountain. An apex of the mountain situating relatively near to the front end constitutes a contact point 20*d* for a corresponding male type connecting terminal.

On both sides of the contact point 20*d* of the movable contact strip 20 there are formed wing portions 20*e*. These wing portions 20*e* are inserted movably into holes 14*a* and 16*a* formed in the first and second side plates 14 and 16, respectively upon constructing the connecting portion 11.

In the bottom plate 13 there is further formed an elongated reinforcing strip 21 by cutting such that a rear end of the reinforcing strip 21 is connected to the bottom plate 13. The reinforcing strip 21 is folded inwardly such that a front end 21*a* is brought into contact with a lower surface of the contact portion 20*d* of the movable contact strip 20.

At the front end of the connecting portion 11, there is provided a guide strip 22, which is formed by folding a front portion of the bottom plate 13 inwardly. The guide strip 22 covers the free front end 20*c* of the movable contact strip 20 to prevent a forward movement of the free front end and to guide the insertion of the corresponding male type connecting terminal. It should be noted that the connecting portion 11 is formed to maintain the rectangular tube by the stabilizer portion 17 or any other member.

Plate-like portions 23 are provided on both sides of a portion adjacent to a front end of the core conductor clamping portion 12*a* such that top edges of the plate-like portions 23 are substantially aligned with top edges of the core conductor clamping portion 12*a* to reinforce the front portion of the core conductor clamping portion 12*a*.

In the connecting terminal according to the invention having the above explained structure, the contact portion 20*d* of the movable contact strip 20 can be provided at a relatively front position within the connecting portion 11, and furthermore since the free end of the movable contact strip 20 is constructed by the front end, a resilient force of the movable contact strip is relatively small and a necessary force for inserting the corresponding male type connecting terminal can be reduced.

Moreover, the up and down movement of the free front end 20*c* of the movable contact strip 20 is limited by the wing portions 20*e* inserted into the holes 14*a* and 16*a* and the upward movement of the free front end 20*c* is limited by the guide strip 22, and therefore the free front end 20*c* is effectively prevented from moving up and down largely and the corresponding male type connecting terminal can be inserted easily.

When the corresponding male type connecting terminal is inserted into the connecting portion 11, the movable contact strip 20 is deformed resiliently to become flat, but since the movable contact strip 20 is supported by the reinforcing strip 21, an excessive deformation of the movable contact strip 20 can be effectively avoided, and at the same time, the corresponding male type connecting terminal can be urged against the contact portion 20*d* with a given pressure.

Figure 5:
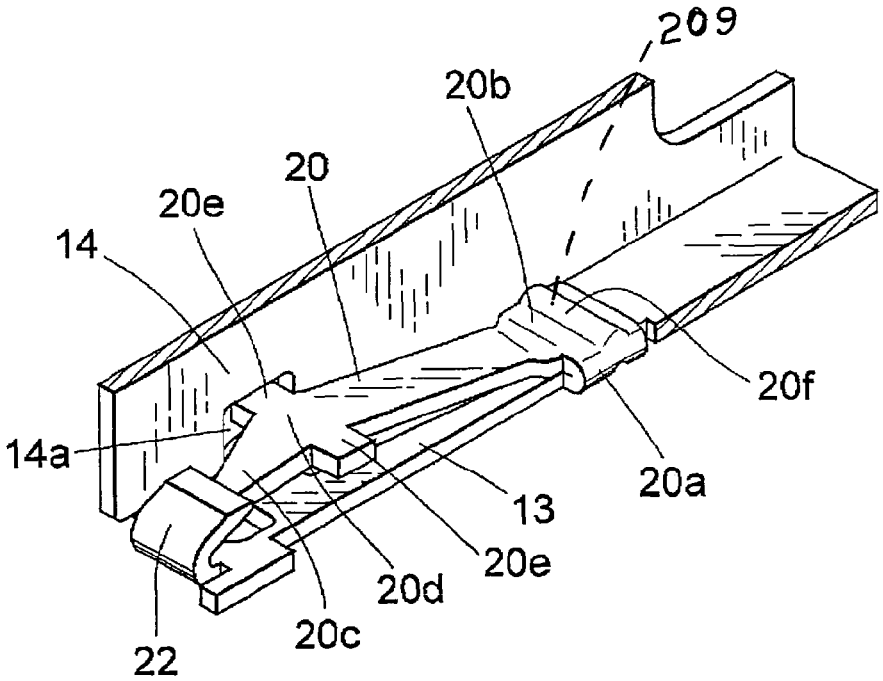
FIG. 5 is an enlarged perspective view representing a portion of a connecting portion of another embodiment of the connecting terminal according to the invention.
Figure 6:
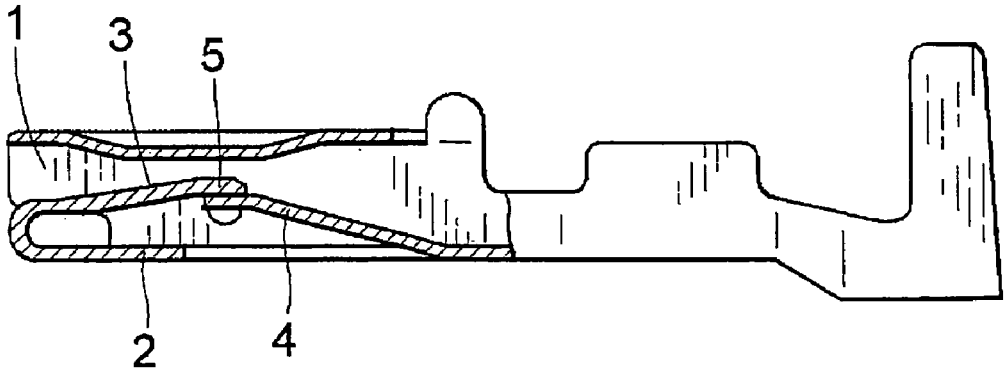
(Prior Art) FIG. 6
FIG. 6 is a cross sectional view illustrating a known connecting terminal.
Figure 7:
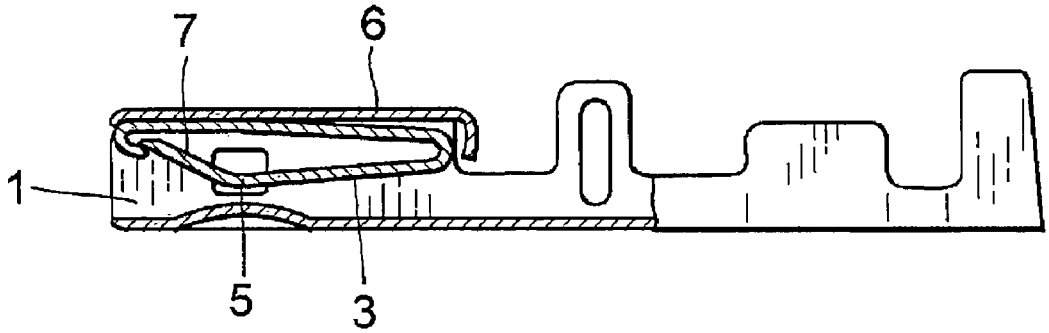
(Prior Art) FIG. 7
FIG. 7 is a cross sectional view showing another known connecting terminal.
Figure 8:
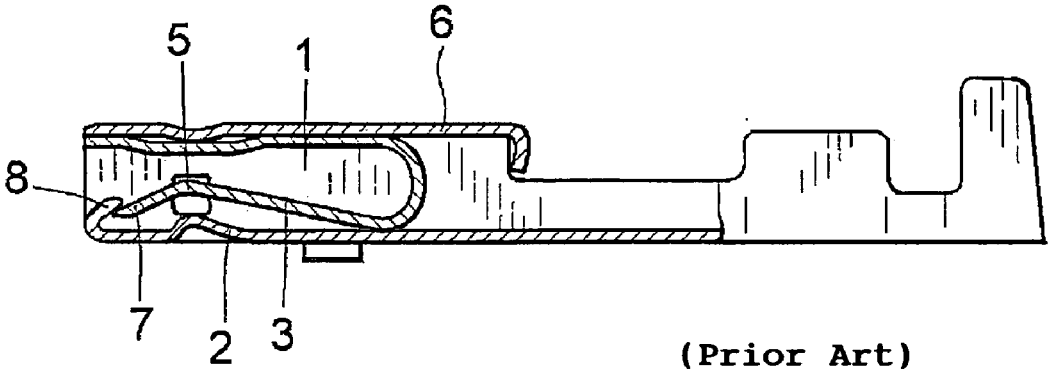
(Prior Art) FIG. 8
FIG. 8 is across sectional view depicting still another known connecting terminal.

FIG. 5 depicts another embodiment of the connecting terminal according to the invention. In this embodiment, a rib 20*f* is formed in the rear portion 20*b* of the movable contact strip 20 as well as a rib 20*g* formed in the bottom plate 13, said rib extending in a direction perpendicular to the longitudinal direction of the connection portion. By forming such ribs 20*f* and 20*g*, the rear end 20*d* of the movable contact strip 20 is fixed to the bottom plate 13 much more firmly. Instead of forming the ribs 20*f* and 20*g*, the rear end 20*b* of the movable contact strip may be fused to the bottom plate 13.

What is claimed is:

1. A connecting terminal formed from a single metal plate comprising a rectangular tube-like connecting portion including a bottom plate, a first side plate connected to the bottom plate, a top plate connected to the first side plate, and a second side plate connected to the top plate; a movable contact strip formed by folding a strip-like member which extends in parallel with a side portion of said bottom plate and is coupled with said bottom plate at a rear portion and has a free end, over said bottom plate within the connecting portion, said strip-like member being further bent into a shape of mountain such that an apex of the mountain constitutes a contact portion; a reinforcing strip having a rear end connected to said bottom plate and a free end, said reinforcing strip being formed by cutting a portion of the bottom plate and bending the cut portion inwardly such that the free end of the reinforcing strip supports the movable contact strip; and a guide strip for guiding a corresponding male type connecting terminal of the electrical connector, said guide strip being formed by folding back a strip-like portion provided at the front end of the bottom plate such that said guide strip covers a front end of the movable contact strip characterized in that a rear end portion is formed at said bottom plate and said movable contact strip by folding back the rear portion of the movable contact strip, where extended ribs are formed in the rear portion of the movable contact strip as well as in a corresponding portion of the bottom plate in a direction perpendicular to the longitudinal direction of said movable contact strip, or said rear end portion comprises the rear portion of the movable contact strip being fused to the bottom plate.

2. The connecting terminal according to claim 1, wherein said free end of the reinforcing strip supports said contact portion of the movable contact strip from underneath.

3. The connecting terminal according to claim 1, wherein said movable contact strip has formed wing portions on both sides, said wing portions being inserted movably into holes formed on the first and second side plates.

4. A terminal including a one-piece metal member, the one-piece metal member comprising:

a first connecting portion adapted to connect to a first conductor;

a second connecting portion connected to the first second connecting portion, wherein the connecting portion comprises a bottom wall, a top wall and two side walls forming a receiving area adapted to receive a mating terminal, wherein the second connecting portion further comprises;

a deflectable contact strip connected to the bottom wall, wherein the deflectable contact strip has a rear end at the bottom wall and extends in a first longitudinal direction of the second connecting portion to a tree end of the deflectable contact strip; and a deflectabLe reinforcing strip extending from the bottom wall in the first longitudinal direction, wherein the reinforcing strip has a free end contacting a bottom side of the deflectable contact strip, wherein the deflectable reinforcing strip comprises a rear end directly connected to the bottom wall, wherein the deflectable reinforcing strip is integrally formed with the bottom wall by cutting a portion of the bottom wall and bending the cut portion inwardly such that the free end of the reinforcing strip supports the contact strip.

5. A terminal as in claim 4 wherein the deflectable contact strip comprises a general mountain shape having an apex forming a mating terminal contact area in the receiving area.

6. A terminal as in claim 4 wherein the second connecting portion comprises a general rectangular tube-like shape.

7. A terminal as in claim 4 wherein a first one of the side walls connects the top wall to the bottom wall, and wherein a second one of the side walls extends directly from the top wall.

8. A terminal as in claim 4 wherein the one-piece metal member comprises a if lat sheet of metal which is stamped and bent, and wherein the deflectable contact strip is fonned by folding a strip-like member of the flat sheet of metal, which extends in parallel with a side portion of the bottom wall before the flat sheet of metal is bent, and wherein the strip-like member is integrally coupled with the bottom wall at the rear end of the deflectable contact strip with a single fold.

9. A terminal as in claim 4 wherein the deflectable contact strip extends over a portion of the bottom wall inside the receiving area.

10. A terminal as in claim 4 wherein the second connecting portion further comprises a guide strip configured to guide the mating terminal, wherein the guide strip is formed by folding back a strip-like portion provided at a front end of the bottom wall such that the guide strip covers a front end of the deflectable contact strip.

11. A terminal comprising a one-piece metal member forming a female connecting portion having a receiving area adapted to receive a mating terminal, wherein the connecting portion comprises a bottom wall, a top wall and two side walls, wherein the connecting portion further comprises:

a movable contact strip integrally formed with the bottom wall and extending from the bottom wall in a general cantilevered fashion, wherein the contact strip has a first end at the bottom wall and extends to a free end; and a movable reinforcing strip integrally formed with the bottom wall and extending from the bottom wall in a general cantilevered fashion to a free end, wherein the free end of the reinforcing strip contacts a bottom side of the movable contact strip and is configured to be moved by the contact strip when the contact strip is moved by the mating terminal inserted into the receiving area, wherein the reinforcing strip comprises a rear end directly connected to the bottom wall, wherein the deflectable reinforcing strip is integrally formed with the bottom wall by cutting a portion of the bottom wall and bending the cut portion inwardly such that the free end of the reinforcing strip supports the contact strip.

12. A terminal as in claim 11 wherein the reinforcing strip extends in a general same forward direction from the bottom wall as the contact strip.

13. A terminal as in claim 11 wherein the contact strip comprises a general mountain shape having an apex forming a mating terminal contact area in the receiving area.

14. A terminal as in claim 11 wherein the connecting portion comprises a general rectangular tube-like shape.

15. A terminal as in claim 11 wherein a first one of the side walls directly connects the top wall to the bottom wall, and wherein a second one of the side walls extends directly from the top wall.

16. A terminal as in claim 11 wherein the one-piece metal member comprises a flat sheet of metal which is stamped and bent, and wherein the contact strip is formed by folding a strip-like member of the flat sheet of metal, which extends in parallel with and directly opposite to a side portion of the bottom wall before the flat sheet of metal is bent, and wherein the strip-like member is integrally coupled with the bottom wall at the rear end of the contact strip with a single fold.

17. A terminal as in claim 11 wherein the contact strip extends over a portion of the bottom wall inside the receiving area.

18. A terminal as in claim 11 wherein the connecting portion further comprises a guide strip configured to guide the mating terminal, wherein the guide strip is formed by folding back a strip-like portion provided at a front end of the bottom wall such that the guide strip covers a front end of the contact strip.

* * * * *

UNITED STATES PATENT AND TRADEMARK OFFICE

CERTIFICATE OF CORRECTION

PATENT NO. : 7,553,203 B2
APPLICATION NO. : 10/561013
DATED : June 30, 2009
INVENTOR(S) : Anbo et al.

It is certified that error appears in the above-identified patent and that said Letters Patent is hereby corrected as shown below:

Claim 4, column 5, line 36, please delete “tree” and replace with --free--.

Claim 4, column 5, line 38, please delete “deflectabLe” and replace with --deflectable--.

Claim 8, column 5, line 59, please delete “if lat” and replace with --flat--.

Claim 8, column 5, line 60, please delete “fonned” and replace with --formed--.

Signed and Sealed this

Twenty-fifth Day of August, 2009

David J. Kappos

David J. Kappos
*Director of the United States Patent and Trademark Office*